United States Patent [19]

Atia

[11] Patent Number: 4,477,785

[45] Date of Patent: Oct. 16, 1984

[54] GENERALIZED DIELECTRIC RESONATOR FILTER

[75] Inventor: Ali E. Atia, Rockville, Md.

[73] Assignee: Communications Satellite Corporation, Washington, D.C.

[21] Appl. No.: 326,643

[22] Filed: Dec. 2, 1981

[51] Int. Cl.[3] ..... H01P 1/203; H01P 7/10

[52] U.S. Cl. ..... 333/202; 333/204; 333/219

[58] Field of Search ..... 333/202–208, 333/212, 219, 227–235

[56] References Cited

U.S. PATENT DOCUMENTS

| | | | |
|---|---|---|---|
| 2,749,523 | 6/1956 | Dishal | 333/212 |
| 3,840,828 | 10/1974 | Linn et al. | 333/204 X |
| 3,973,226 | 8/1976 | Affolter et al. | 333/202 |
| 4,360,793 | 11/1982 | Rhodes et al. | 333/212 |

FOREIGN PATENT DOCUMENTS

| | | | |
|---|---|---|---|
| 0041153 | 4/1978 | Japan | 333/202 |

OTHER PUBLICATIONS

Williams et al.—"Dual-Mode Canonical Waveguide Filters", IEEE Trans. on Microwave Theory and Techniques, vol. MTT-25, No. 12, Dec. 1977; pp. 1021–1026.

*Primary Examiner*—Marvin L. Nussbaum

*Attorney, Agent, or Firm*—Sughrue, Mion, Zinn, Macpeak & Seas

[57] ABSTRACT

A generalized dielectric resonator filter is disclosed for the realization of the most general transfer function characteristics of band-pass filters using cylindrical dielectric resonator discs in a microstrip transmission line configuration. The dielectric resonator filter of the invention has electrical properties comparable to conventional waveguide filters, but has a much smaller volume and mass, and is thus very attractive for use in the construction of input multiplexers of communications satellite transponders.

8 Claims, 11 Drawing Figures

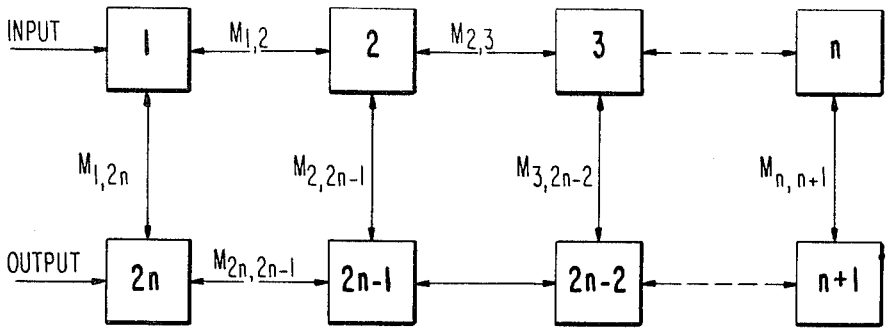
FIG. 1 CANONICAL FORM OF A 2n CAVITY FILTER.
"SERIES" COUPLINGS $M_{12}$, $M_{23}$, ---- $M_{n,n+1}$ ALL HAVE SAME SIGN (POSITIVE);
"SHUNT" COUPLINGS $M_{1,2n}$, $M_{2,2n-1}$, ---- $M_{n-1,n+2}$ MUST BE EITHER POSITIVE OR NEGATIVE FOR ARBITRARY REALIZATION.
FIG. 2
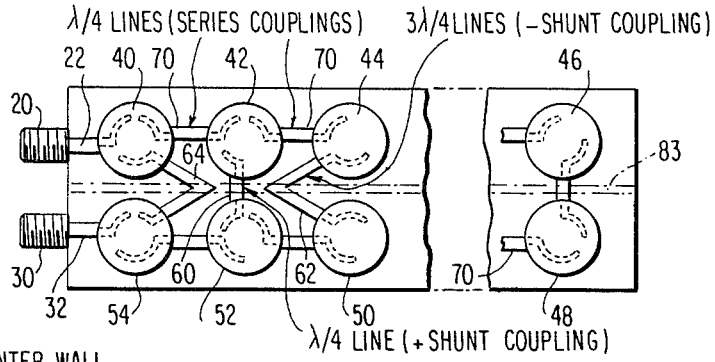
FIG. 2a
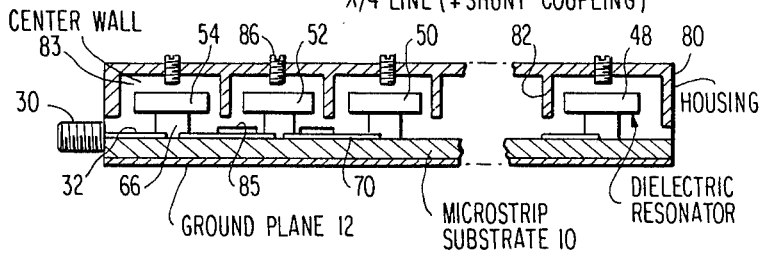
FIG. 4
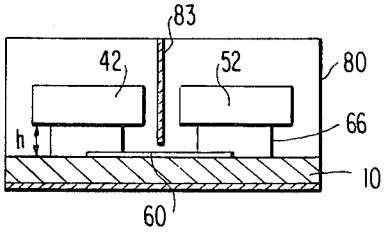
FIG. 4a
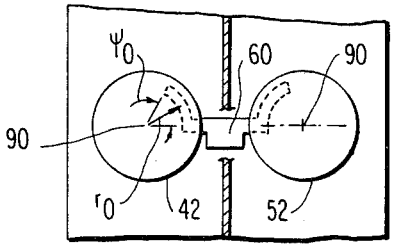

FIG. 3
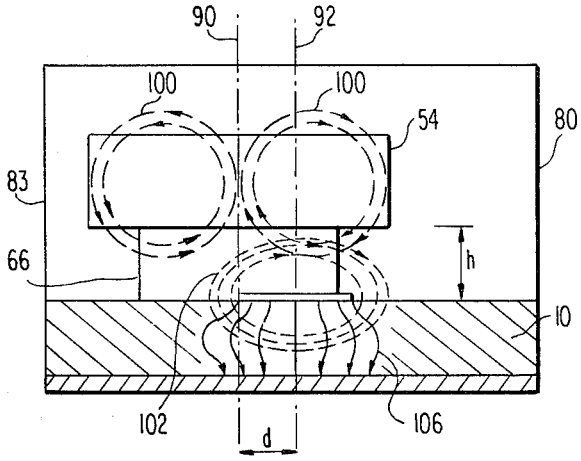
FIG. 5
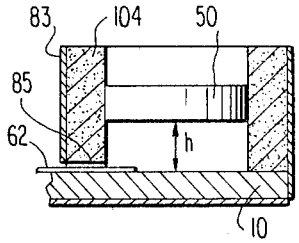
FIG. 5a
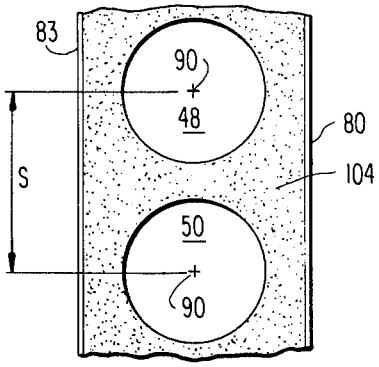
FIG. 3a
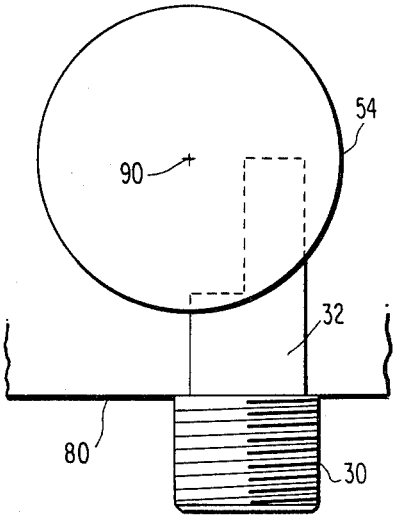
FIG. 6a EQUIVALENT CIRCUIT OF MICROSTRIP COUPLED DIELECTRIC RESONATORS.
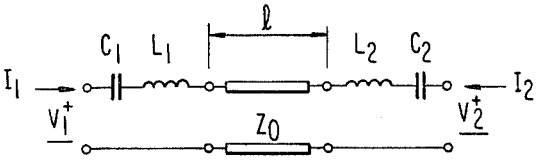
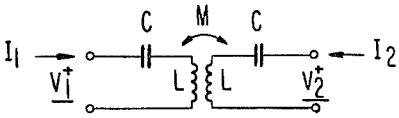
FIG. 6b DIRECT-COUPLED CAVITY EQUIVALENT CIRCUIT

GENERALIZED DIELECTRIC RESONATOR FILTER

BACKGROUND OF THE INVENTION

1. Field of the Invention

The present invention generally relates to bandpass filters, and more particularly to dielectric resonator filters which realize the most general transfer functions of bandpass filters.

2. Description of the Prior Art

High quality bandpass filters of narrow band width are required in many applications, including satellite transponder input multiplexers. Implementation of such filters in the past has been accomplished by using waveguide cavities in order to achieve the required large, unloaded Q. Considerable work has been done by the present inventor and others towards the realization of the most general bandpass transfer functions, including the elliptic function response and the more general transfer functions with finite complex transmission zeros, in waveguide form. U.S. Pat. Nos. 3,697,898 to Blanchier and Champeau; and 3,969,692 and 4,060,779 issued to the present applicant and Williams show how to construct relatively compact structures in waveguide form which realize the above-mentioned transfer functions.

Although the dual mode waveguide realizations of the most general transfer functions of bandpass filters represent a significant reduction of the weight and size of the multiplexers of communication satellites, the size and weight of these devices still represent a very significant portion of the payload. An example of such a dual mode filter is disclosed in the latter of the above-mentioned patents. The trend towards integration of various transponder components into microwave integrated circuit form (MIC) is not advanced with the use of waveguide multiplexers. Additionally, waveguide filters are relatively expensive components to manufacture, since the construction thereof involves extremely accurate machining operations with very tight tolerences.

The present invention takes advantage of recent advances in the developments of low loss, high relative dielectric constant materials, for example, ceramic barium titanate $BA_2TI_9O_{20}$. Although bandpass filters of the all pole type (e.g. Tchebycheff, Butterworth, etc.) have been described using dielectric resonators, the most general transfer functions have not been previously realized in this form. It is the purpose of the present invention to illustrate how the most general class of bandpass filter functions, including elliptic functions and transfer functions with finite real, imaginary or complex transmission zeros, can be realized using dielectric resonators in a microstrip transmission line configuration. Since the dielectrics have a high relative dielectric constant, the size of a filter using the dielectric resonators is significantly smaller than a corresponding wave-guide filter. Further, since the transmission line medium in which the filters are realized is in the form of a microstrip, microwave integration is feasible with significant advantages both in production cost and in satellite transponder construction.

Examples of microwave filters employing dielectric resonators may be found in U.S. Pat. Nos. 4,184,130; 4,180,787; 4,132,233; 4,142,164; 4,135,133; 4,124,830; 4,121,181; 4,060,779; 4,028,652; 3,973,226; 3,969,692; 3,840,828; 3,713,051 and 3,697,898.

BRIEF DESCRIPTION OF THE DRAWINGS

The invention will be better understood from the following detailed description with reference to the attached drawings, in which:

FIG. 1 is a schematic representation of the canonical form of a 2*n* cavity filter, also indicating couplings between the several cavities;

FIG. 2 illustrates the present invention, where the canonical form band pass filter is realized using dielectric resonators and microstrip transmission lines;

FIG. 2*a* is a partial cut-away side view of FIG. 2, illustrating the microstrip substrate and housing features;

FIG. 3 is an explanatory diagram illustrating a microstrip line-resonator coupling;

FIG. 3*a* is a top view of the coupling of FIG. 3;

FIGS. 4 and 4*a* depict portions of the device of FIG. 2, in front and top view, respectively, illustrating resonator-resonator coupling between physically adjacent but electrically non-adjacent resonators;

FIGS. 5 and 5*a* are front and top views, respectively, of an alternative method for direct coupling of series resonators; and, FIGS. 6*a* and 6*b* are explanatory equivalent circuit diagrams.

DETAILED DESCRIPTION OF THE INVENTION

It is well known that the most general bandpass transfer function characteristics can be realized by means of the canonical form structure of coupled cavity resonators, as described in Atia et al. "Narrow Band Multiple Coupled Cavity Synthesis", IEEE Trans. on Circuits and Systems, Vol. CAS-21, No. 5, pages 649–655, 1976. For an even number of cavities, this canonical form is symmetrical and consists of two identical "halves". Each of the two halves consists of n direct coupled cavities having "series" couplings of the same sign. Each cavity in one half is coupled to a corresponding cavity in the other half by "shunt" couplings of arbitrary sign. Illustrated in FIG. 1 is a schematic diagram of the canonical form of a 2*n* resonator filter. The "series" couplings $M_{12}$, $M_{23}$, . . . $M_{n,n+1}$ all have the same sign (positive) while the "shunt couplings" $M_{12n}$, $M_{2,2n-1}$, $M_{n-1,n+2}$ must be either positive or negative for arbitrary transfer function realization. Realization of the canonical form by means of dielectric resonators and microstrip transmission lines is the subject of the present invention, and will be described hereinafter.

As indicated previously, a number of dielectric resonator filters are known, but even the best of these filters can realize only a very limited class of transfer functions, namely all pole transfer functions which have no finite zeros of transmission. The present invention represents a substantial step forward in the art by providing a dielectric resonator filter structure that is capable of realizing the most general band pass transfer functions, namely, transfer functions that possess finite transmission zeros. This is achieved in the present invention by providing a canonical form filter where resonators are coupled serially by one-quarter wavelength couplings, while physically adjacent, but electrically non-adjacent resonators are coupled by a mixture of one-quarter or three-quarter wavelength shunt couplings.

FIGS. 2 and 2*a* illustrate the canonical form filter using ceramic barium titanate dielectric resonators and microstrip transmission lines. The several lines are disposed upon a microstrip substrate 10 having a ground plane 12. The input to the filter is in the form of a coaxial connector 20 which launches energy to an input microstrip line 22. The output of the filter is taken via a similar coaxial connector 30, from an output microstrip line 32.

Between input and output are arranged a series of circular cylindrical dielectric resonators 40–54, numbering 2*n*. To facilitate the present discussion, it will be assumed that there are eight such resonators, although the actual number may be lesser or greater, as indicated by the dotted lines in FIGS. 2 and 2*a*. From input to output, resonators 40, 42, 44, 46, 48, 50, 52, and 54, are serially connected by means of positive "series" couplings 70 comprised of microstrip lines of a length equal to $\lambda/4$ (one-quarter wavelength). Resonators 40, 54; 42, 52; and 44, 50 are interconnected by shunt couplings 64, 60, 62, which may be either positive or negative. The length of the transmission line through which the energy travels from one resonator to the other determines the sign of the couplings, the coupling being positive for microstrip lengths equal to $\lambda/4$, and being negative for microstrip lengths of $3\lambda/4$, as will become more apparent later. In FIG. 2, microstrip lines 62, 64 are shown, for illustrative purposes, as being $3\lambda/4$ lines, and thus negative couplings, while microstrip line 60 positively couples resonators 42, 52, as its length is $\lambda/4$. For the most general band pass transfer functions to be realized, the shunt couplings 60, 62, 64 must be arbitrary, that is, either positive or negative, while the series couplings are all of the same sign.

Referring now more particularly to FIGS. 2*a* and 3, it is seen that the several circular dielectric resonators are mounted upon dielectric spacers 66 having a height h. The resonators are enclosed within a metallic cover or housing 80, the housing 80 being provided with internally formed partial walls 82 which separate series connected resonators. Also, a center wall 83 separates resonators 40–46 from 48–54. In this manner, the direct evanescent fields of the resonators are prevented from producing couplings, while the microstrip lines 70 can pass underneath the partial walls. Shunt coupling lines 60–64 pass through slots 85 provided in center wall 83, as does the series strip line coupling resonators 46, 48. In this configuration, all resonator-resonator couplings are realized in the microstrip, and are therefore controlable to a high degree by the line's characteristic impedances. Conversely, some increase in losses occurs in this configuration because of the added housing surrounding the resonators, and the inevitable conductor losses in the microstrip.

The separation walls 82 and center wall 83 separating adjacent resonators may be easily formed by cutting cyclindrically shaped recesses directly into a thick metal cover member 80, spaced in a manner so as to surround each of the several resonators upon assembly. In addition, fine tuning means in the form of screws 86 may be added for tuning the center frequency of the resonators in a known fashion.

FIG. 3 illustrates the coupling between a microstrip line and one of the dielectric resonators. The central axis of the resonator is represented by 90, and the center of the microstrip line by 92. As is evident from FIG. 3, the lines 90, 92 are separated by a distance d. The magnetic field of the resonator is indicated by numeral 100, with the direction being shown by arrows. Since FIG. 3 shows the field of the dielectric in cross section, only a small portion of the overall toroidal field is seen. The resonator field illustrated corresponds to the fundamental $TE_{01\delta}$ mode in the dielectric circular cylinder, which is dominant in practice. The microstrip magnetic field is similarly indicated at 102 with arrows again denoting the direction of the field. The electric field of the microstrip line through the substrate to the ground plane 12 is indicated at 106.

Normally, the distance d is selected so as to allow the peaks of the magnetic fields of the resonator and microstrip to coincide. This will produce a coupling maximum with respect to the transverse position of the resonator, and the coupling will be relatively insensitive to variations in the offset distance d. Therefore, the value of the coupling may be easily controlled by controlling the height h of the resonator above the microstrip substrate. In the present embodiment, this can be easily effected by varying the height of the dielectric spacers 66.

The net resonator-microstrip coupling is the difference between the positive and negative couplings due to magnetic fields on both sides of the resonator center line, as can be seen in FIG. 3. In particular, the coinciding resonator/microstrip magnetic field lines running in the opposite direction produce positive coupling, as is the case on the right in FIG. 3. The coupling magnitude is reduced in amount by the negative coupling produced by the magnetic fields running in the same direction (i.e., on the left in FIG. 3).

Although the coupling between resonator and microstrip line can be effected by merely extending a linear portion of the microstrip beneath the resonators, as illustrated in FIG. 3*a*, coupling is made more efficient by using the configuration shown in FIGS. 4 and 4*a*. In this embodiment, the microstrip line in the coupling region consists of a circular arc of radius $r_o$, the center of which coincides with the axis of the cylindrical resonator. As seen in this figure, the circular arc portion subtends an angle $\psi_o$ as measured from the dielectric center. By properly choosing the radius $r_o$, this coupling scheme allows the peak of the angular magnetic field $H_\theta$ of the resonator to coincide with the peak of the magnetic field of the arc of microstrip line. In the prior embodiment using a linear microstrip line, it was necessary to carefully control the offset d to achieve good coupling, and even then the respective magnetic fields of the resonator and the microstrip were in perfect coincidence only along a single line. In the present embodiment, however, the respective fields are in coincidence over a substantial arc, and it is no longer necessary to offset the incoming microstrip by a distance d, as is evident from FIG. 4*a*. In addition to being controllable by means of the height h, the magnitude of the microstrip-resonator coupling in this embodiment can be controlled by suitably limiting the angle $\psi_o$. It will be noted that all of the couplings illustrated in FIG. 2 are of the improved circular arc type.

In the filter embodiment of FIG. 2, coupling between the several series resonators 40 to 54 are achieved via microstrip, as are the shunt couplings 60 to 64, which pass from resonator to resonator under the common separating wall 83 separating the two rows of resonators (FIGS. 2, 4). In such a case, the resonators are coupled indirectly by first coupling energy from a resonator to the stripline, and then from the line to the adjacent resonator. However, it is possible to directly couple the series connected resonators, without need of microstrip. In particular, in this configuration, the series couplings are realized by the evanescent fields inside a waveguide beyond cutoff, while the shunt couplings are still realized by microstrip lines. For convenience of housing manufacture, it is preferred that the coupling between resonators 46, 48 still be realized in microstrip configuration also. In this case, the filter housing consists of two rectangular boxes divided by a common wall again partially open at its bottom by means of slots 85, etc., allowing for the shunt microstrip couplings between the corresponding resonators 40, 54; 42, 52; 44, 50 and the series coupling between resonators 46, 48.

As noted, the dimensions of the housing must be chosen such that it is a waveguide beyond cutoff for the frequency band of interest, so as to avoid spurious modes. The resonators may be mounted as shown in FIG. 5, it being understood that, as in FIG. 3, the illustrated resonator is connected via a shunt coupling to a corresponding resonator situated to the left in FIG. 5, via the space or slot 85 between the metal housing common wall 83 and the substrate. As can be seen from FIGS. 5 and 5*a*, the cylindrical resonators are mounted in abutting relationship with a plastic foam holder 104, which can be used to replace the dielectric spacers 66 of the embodiment of FIGS. 2 and 2*a*, if desired. Since the plastic foam is virtually invisible to microwave frequency radiation, the foam can fill a majority of the housing, if desired, or can be used to mount the resonators from above or below. The height h of the resonator above the substrate or microstrip can thus be easily changed by merely adjusting the resonator up or down within the holder 104.

As seen in FIG. 5*a*, the centers of two series connected dielectric resonators are separated by a distance s. For direct coupling, the distance s must be precisely controlled to provide the appropriate coupling. However, the direct coupled configuration has the advantage of being a lower loss structure than the previously discussed embodiment, due to the realization of the series couplings through the cutoff waveguide fields, thereby avoiding the conductor losses of the microstrip. A manner of computing the coupling coefficient between two identical adjacent resonators disposed as in FIG. 5 may be readily computed, and the separation distance accordingly set such that the desired coupling value is achieved. A method of computation which has previously been developed is disclosed by S. B. Cohen, in "Microwave Band Pass Filters Containing High-Q Dielectric Resonators", IEEE Trans. Microwave Theory and Techniques, Vol. MTT-16, pages 818 through 829, October, 1968.

A determination of the coupling coefficient between physically adjacent but electrically non-adjacent resonators mounted as shown, for example, in FIGS. 4 and 4*a* can be deduced from a knowledge of the resonator-microstrip coupling of the configuration of FIG. 3, and the equivalent circuit of the line length connecting the resonators. Such a calculation will be equally applicable to determining coupling coefficients between serially connected resonators coupled via microstrip line. Assuming that the coupling coefficient between resonator and microstrip (as in either FIGS. 3*a* or 4*a*) is known, then the equivalent circuit of two resonators coupled as in FIG. 4 appears as illustrated in FIG. 6*a*. By calculating the open circuit impedance parameters of the circuit shown in FIG. 6*a* and the direct coupled cavity equivalent circuit shown in FIG. 6*b*, and identifying the corresponding elements, the coupling coefficient M between the two microstrip coupled cavities can be obtained. The condition for equivalence between the two circuits can quite easily be shown to be $$\cot \beta l = 0, \text{ i.e. } l = ((2k+1)\lambda)/4, k = 0, 1, 2, \ldots$$

where λ is the line wavelength in the dielectric substrate.

For the values of l given by the above relation, the coupling between the two cavities can be shown to be:

$$M = \frac{1}{\sqrt{Q_{e1}Q_{e2}}}(-1)^k$$

From the foregoing relationship, it is clear that for a positive coupling coefficient, the line length l must be one-quarter wavelength (or 5/4 λ, etc.), and for a negative coupling, the line length must be three-quarter wavelength (or 7/4 λ, etc.). Couplings of both signs, therefore, are realizable by proper choice of line length, while the magnitude of the coupling is controlled primarily by the height h of the dielectric resonator above the microstrip. As discussed previously, the coupling magnitude may also be controlled via the arc radius $r_o$, the angle $\psi_o$, the offset distance d, (if the linear coupling line of FIG. 3*a* is used) and the characteristic impedance $Z_o$ of the microstrip lines.

It should now be obvious that the embodiment of FIG. 2 corresponds directly to the canonical realization schematically illustrated in FIG. 1. The series couplings $M_{12}$, $M_{23}$, etc., of FIG. 1 are realized by quarter-wavelength line lengths, while the shunt couplings $M_{1,2n}$, $M_{3,2n-2}$, etc., are realized by either one quarter wavelength or three quarter wavelength line lengths, depending on whether positive or negative couplings are desired.

While the foregoing embodiments are at present considered to be preferred, it is understood that numerous variations and modifications may be made therein by those skilled in the art, and it is intended to cover in the appended claims all such variations and modifications as fall within the true spirit and scope of the invention.

What is claimed is:

1. A generalized canonical form filter for electromagnetic waves, comprising an input, an output and a plurality of dielectric resonators disposed between said input and said output, said resonators being serially coupled by series couplings of the same sign, physically adjacent but electrically non-adjacent resonators being coupled by shunt couplings of arbitrary sign, wherein said couplings comprise microstrip lines extending between said resonators, said lines terminating in arcuate portion having a radius originating at the centers of said resonators.

2. A filter as claimed in claim 1, wherein said electrically non-adjacent resonators are separated by a central wall, and are coupled by means of λ/4 or 3λ/4 length microstrip lines running between said resonators and beneath said central wall.

3. A filter as claimed in claim 1 or 2, wherein said resonators are disposed in two adjacent rows, and within each row said series couplings comprise microstrip lines disposed on a substrate, said resonators being separated by partial walls and said series couplings running beneath said partial walls.

4. A filter as claimed in claim 1 or 2, wherein said resonators are disposed in two adjacent rows, and within each row said series couplings comprising directly coupled resonators.

5. A filter as claimed in claim 1, wherein said resonators are disposed above said microstrip coupling lines by a distance, the value of said couplings being adjustable primarily by varying said distance.

6. A filter as claimed in claim 5, said resonators being supported by dielectric spacers.

7. A filter as claimed in claim 5, said resonators being supported by foam support members.

8. A filter as claimed in claim 1, said filter being disposed within a housing having a central wall separating adjacent rows of resonators, at least said shunt couplings comprising microstrip lines between resonators, said microstrip lines being disposed on a substrate covered by said housing, said resonators being spaced from said substrate.

* * * * *

UNITED STATES PATENT AND TRADEMARK OFFICE

CERTIFICATE OF CORRECTION

PATENT NO. : 4,477,785

DATED : October 16, 1984

INVENTOR(S) : Ali E. ATIA,

It is certified that error appears in the above-identified patent and that said Letters Patent is hereby corrected as shown below:

Column 1. line 24, "Blanchier" should be --Blachier--.

Column 3, line 49, "controlable" should be --controllable--.

Column 6, line 56, "portion" should be --portions--.

Signed and Sealed this

*Seventeenth* Day of *September 1985*

[SEAL]

*Attest:*

DONALD J. QUIGG

*Attesting Officer*

*Commissioner of Patents and Trademarks—Designate*